US006062037A

United States Patent [19]

Yoon

[11] Patent Number: 6,062,037

[45] Date of Patent: May 16, 2000

[54] REFRIGERATED AIR SUPPLY APPARATUS FOR REFRIGERATOR

[75] Inventor: Kyung Seok Yoon, Kyungnam, Rep. of Korea

[73] Assignee: LG Electronics Inc., Seoul, Rep. of Korea

[21] Appl. No.: 09/076,128

[22] Filed: May 12, 1998

[30] Foreign Application Priority Data

May 29, 1997 [KR] Rep. of Korea ..... 97-21669
May 29, 1997 [KR] Rep. of Korea ..... 97-21670

[51] Int. Cl.[7] ..... F25D 17/04

[52] U.S. Cl. ..... 62/407; 62/408; 62/441

[58] Field of Search ..... 62/407, 408, 441

[56] References Cited

U.S. PATENT DOCUMENTS

| | | | |
|---|---|---|---|
| 3,924,601 | 12/1975 | Nuss | 126/21 |
| 5,584,191 | 12/1996 | Kwon | 62/417 |
| 5,826,437 | 10/1998 | Kim | 62/186 |
| 5,896,752 | 4/1999 | Park | 62/186 |

*Primary Examiner*—Henry Bennett
*Assistant Examiner*—Mark Shulman

[57] ABSTRACT

A refrigerator includes at least a compartment defined by inner walls and a door closing the compartment. A providing duct mounted in a inner wall of the compartment and a door duct mounted in the door simultaneously provide refrigerated air to the compartment forward and rearward respectively. A connecting duct was provided along with a shelf or a storage box mounted at the bottom of the compartment to deliver refrigerated air from the providing duct to the door duct.

20 Claims, 4 Drawing Sheets

REFRIGERATED AIR SUPPLY APPARATUS FOR REFRIGERATOR

BACKGROUND OF THE INVENTION

1. Field of the Invention

This invention relates to a refrigerated air supply apparatus for a refrigerator, and more particularly a refrigerated air supply apparatus for providing refrigerated air forward and rearward from a rear wall of fresh food compartment and from a door respectively.

2. Description of Background Art

As is shown in FIG. 1, generally a refrigerator has a freezer compartment 10 and a fresh food compartment 20 partitioned by an insulation barrier 5. The compartments 10, 20 are defined by inner cases 12, 22, respectively surrounded by insulation 7 which is cased by an outer case 2. And a fan unit 4 which is for providing refrigerated air to both freezer compartment 10 and fresh food compartment 20 is located in an evaporating chamber 11 located at the rear of the freezer compartment 10. An evaporator 8 is also provided in the evaporating chamber 11 which evaporator 8 generates refrigerated air by heat exchange. The compartments 10, 20 are closed by doors 19, 29 which are hinged in front of the refrigerator. A plurality of shelves 27, which store the food to be cooled, are mounted horizontally in the fresh food compartment 20. And at the bottom of the fresh food compartment 10, a storage box 28 is slidably mounted to keep a kind of food such as vegetables or fruits in which its temperature is maintained cooler than the rest of the fresh food compartment 10. And the doors 19, 29 have door baskets 26 mounted at inner surfaces thereof. The doors 19, 29 may be formed integrally with the door liner.

Conventional refrigerated air circulation will be explained in view of FIG. 1. As refrigeration cycle drives, the refrigerated air is generated by the evaporator 8 in which working fluid or refrigerant flows. By the fan unit 4, a portion of the refrigerated air is directed to the freezer compartment 10, and the other portion of the refrigerated air is impinged on a grill 16 and then guided to fresh food duct 24 through a passage 15 defined by a shroud 14 and a grill 16. The refrigerated air in the fresh food duct 24 is blown out into the fresh food compartment 20 through a plurality of outlets 25 formed in the front surface thereof.

Refrigerated air supplied to fresh food compartment 20 via above-mentioned supply path, then moves forward and carries out heat exchanges with food stored on the respective shelves 27, thereby becoming relatively warmed air. The warmed air returns to the evaporating chamber 11 through a return duct 30 formed in the insulation barrier 5 with its inlet 31 adjacent to the door 29. And the warmed air returned to evaporating chamber 11 carries out heat exchanges with the evaporator 8, thereby becoming refrigerated air.

But the conventional refrigerated air circulation system has a number of shortcomings. First, it can not achieve uniform refrigerating effect in the whole fresh food compartment 20, since the refrigerated air is provided only one direction, forward, from the outlets 25 of fresh food duct 24. This means that the temperature of a portion adjacent to the outlets 25 is lower than that of a portion adjacent to the door 29. Therefore, food stored adjacent to the outlets 25 may be over-refrigerated while food stored adjacent to the door 29 is tend to be perishable due to the temperature difference. This problem is based on the fact that the refrigerated air is provided into the fresh food compartment 20 only one direction from the duct 24. Second, the temperature of the door-adjacent portion in the fresh food compartment 20 tends to be increased due to frequent opening of the door 29. It takes relatively longer time to decrease the temperature of door-adjacent portion than that of the portion adjacent to the fresh food duct 24. Third, it is difficult to keep the food fresh stored in the door baskets 26, due to inflow of warm air from outside when door opened.

An improved refrigerated air circulation system was described in U.S. Pat. No. 5,584,191 issued Dec. 17, 1996. According to the air circulation system, refrigerated air is blown out into fresh food compartment by either a cool air duct mounted at the corner of the fresh food compartment and door duct into which the refrigerated air is provided by a transmission duct mounted on a side wall respectively. The transmission duct is exposed to the interior of fresh food compartment and it only delivers refrigerated air which have been spouted in fresh food compartment through the cool air duct to the door duct. The air circulation system has still following problems although it improves homogeneous refrigerating effect by the refrigerated air spouted from the door duct.

A problem with the circulation system is that the transmission duct occupies a certain space in the fresh food compartment where food is stored so that the substantial storage space in fresh food compartment is restricted by the transmission duct.

Another problem is that the contour of the circulation system particularly contour of the transmission duct mounted in the side wall is not good in design.

SUMMARY OF THE INVENTION

It is an object of the invention to provide an improved refrigerated air supply apparatus that provides refrigerated air homogeneously in the fresh food compartment.

It is another object of the invention to provide an improved air supply apparatus that provides sufficient refrigerated air to the door adjacent portion, to keep foods stored in the door baskets fresh.

It is still another object of the invention to provide sufficient refrigerated air to the storage box mounted at the bottom of the fresh food compartment.

These and other objects are provided by the invention which defines a refrigerated air supply apparatus comprising a providing duct mounted on an inner wall of the compartment for providing refrigerated air to the compartment; a component mounted in the compartment for storing food; a connecting duct mounted along with said component and communicating with the providing duct to deliver refrigerated air; and a door duct mounted in the door and spouting refrigerated air rearward which is delivered by the connecting duct.

The component may be either a shelf mounted horizontally in the compartment or a storage box mounted at the bottom of the compartment.

The refrigerated air supply apparatus according to the invention make it possible to cool the compartment more homogeneously and promptly. And the door duct provides sufficient refrigerated air to the door adjacent portions, thereby keeping food fresh stored in that portion and stored in door basket.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
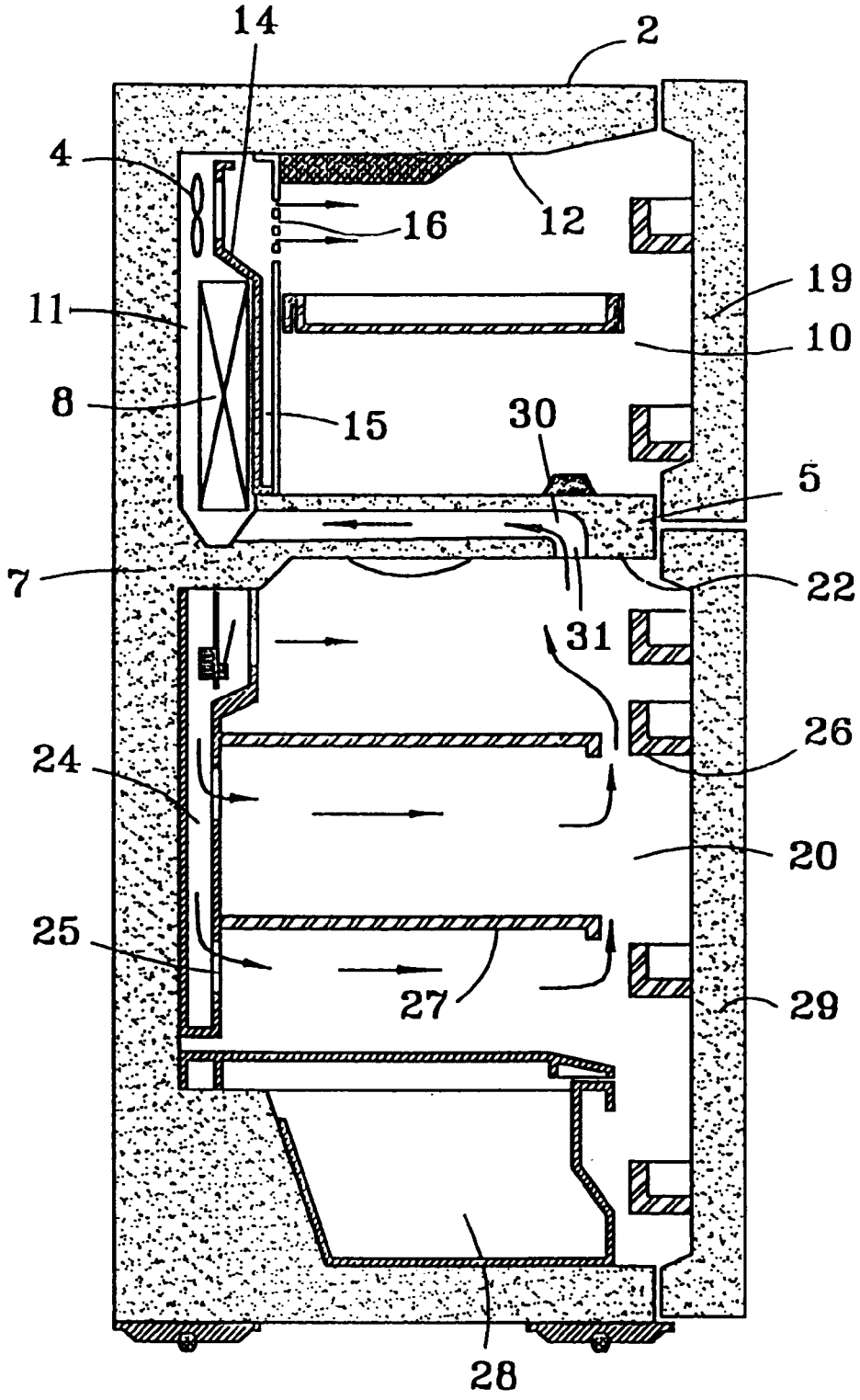
FIG. 1 is a side section view of the conventional refrigerator showing conventional refrigerated air circulation.
Figure 2:
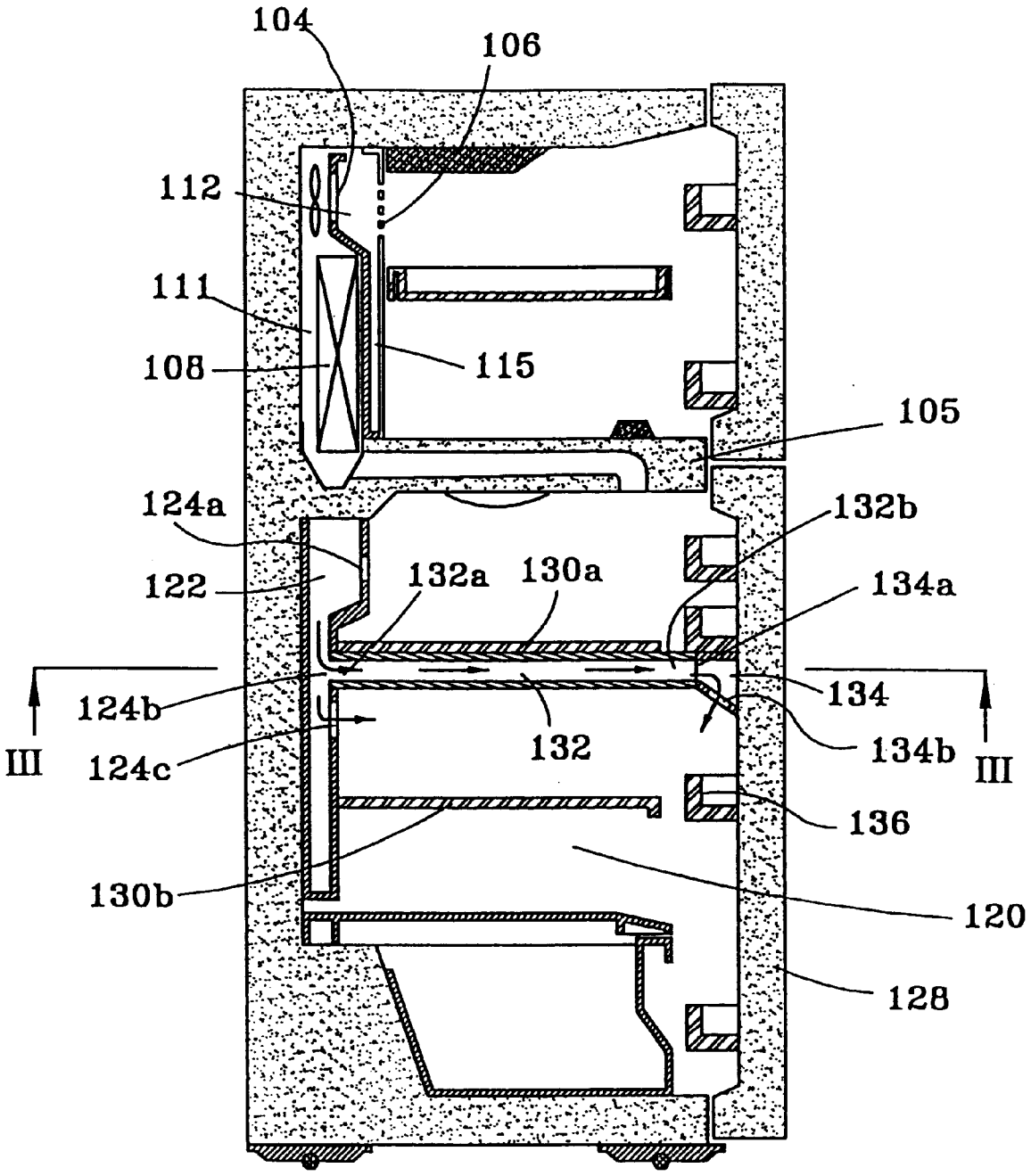
FIG. 2 is a longitudinal side section view showing a refrigerated air supply apparatus in accordance with an embodiment of the present invention.
Figure 3:
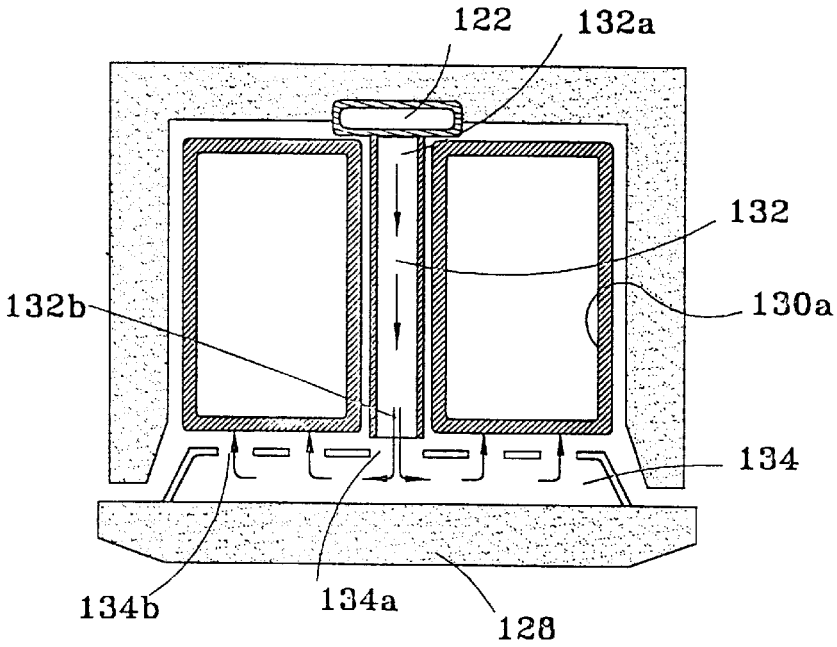
FIG. 3 is a section view taken substantially along the lines III—III in FIG. 2.

With reference to FIGS. 2 and 3 where the first embodiment of the invention illustrated, a refrigerated air supply apparatus of this embodiment includes a shelf duct 132, as a connecting duct, to deliver refrigerated air from a fresh food duct 122 installed at rear wall of the fresh food compartment 120 to a door duct 134 mounted in a door 128. The refrigerated air generated by an evaporator 108 can be provided through two passages formed by a fresh food duct 122 and the door duct 134 respectively.

The first refrigerated air supply passage is formed by the fresh food duct 122 mounted at the rear wall of fresh food compartment 120. Refrigerated air generated by the evaporator 108 in a refrigerating chamber 111 is guided to the fresh food duct 122 through a passageway 115 defined by a shroud 104 and a grill 106. Then, the refrigerated air in the fresh food duct 122 is spouted into the fresh food compartment 120 via a plurality of outlets 124*a,* 124*b,* 124*c* formed in the front surface thereof.

The second passage is formed by the door duct 134 to which refrigerated air is delivered by the shelf duct 132. The refrigerated air delivered to the door duct 134 is spouted rearward into the fresh food compartment 120. Refrigerated air is spouted into the fresh food compartment 120 forward and rearward simultaneously so that fresh food compartment 120 can be cooled homogeneously and promptly.

A plurality of shelves 130*a,* 130*b* are mounted horizontally in the interior of the fresh food compartment 120. According to this embodiment, at least one of the shelf 130*a* have a shelf duct 132, as a connecting duct which delivers refrigerated air to the door duct 134. The shelf duct 132 shown in FIG. 2 is mounted on undersurface of the shelf 130*a*. But shelf duct 132 can be mounted across the shelf 130*a,* thereby to form same plain with the shelf 130*a*. An inlet 132*a* of the shelf duct 132 is communicated with the interior of fresh food duct 122, and an outlet 132*b* of the shelf duct 132 is communicated with an inlet 134*a* of the door duct 134 when the door 128 is closed.

The contour and structure of the shelf duct 132 may be modified within a scope of this invention where the inlet 132*a* and outlet 132*b* of connecting duct 132 provide communication with fresh food duct 122 and door duct 134 respectively. For example, the shelf duct 132 can be installed on the upper surface of the shelf 130*a*. Otherwise, the shelf duct 132 can be installed along with outskirts of the shelf 130*a* as a connecting duct which connects fresh food duct 122 and door duct 134. When the fresh food duct is mounted in a side wall of fresh food compartment 120, the inlet of the shelf duct 132 is formed at the side thereof corresponding to the fresh food duct, thereby delivering refrigerated air to the door duct 134.

The shelf duct 132 can be formed separately and then assembled to the shelf 130*a*. And the shelf duct 132 can be formed integrally with the shelf 130*a*.

Refrigerated air in the shelf duct 132 is guided to the door duct 134 when door 128 is closed. Door duct 134 mounted in the door 128 spouts refrigerated air rearward through its outlets 134*b* in fresh food compartment 120. Door duct 134 is mounted under the door basket 136 in which foods are stored. Preferably, refrigerated air spouted from the outlets 134*b* of the door duct 134 is passing across the foods stored in the door basket 136. The food stored in the door basket 136, therefore, may be easily chilled by the refrigerated air spouted into the fresh food compartment 120. In this embodiment, the door duct 134 is mounted horizontally and have a plurality of outlets 134*b*. And it is understood that the door duct 134 may be mounted vertically with outlets formed in front surface thereof.

As stated above, the door duct 134 of the invention can be practiced in the range that it receives refrigerated air from the fresh food duct 122 through the shelf duct 132 and then spouts it rearward into the fresh food compartment 120. And FIG. 2 illustrates only one shelf duct 132, but a plurality of shelf ducts can be applied to each shelves mounted in the fresh food compartment 120. Otherwise one or a pair of shelf duct can be selectively mounted to the shelves.

Refrigerated air provided into the fresh food compartment 120 through the door duct 134 will mainly cool the door adjacent portion of fresh food compartment 120. It is preferable that the outlets 134*b* of the door duct 134 is formed in a manner that refrigerated air spouted therefrom is passing across the food stored in the door basket 136. Food stored in the door basket 136 will be kept fresh, since new refrigerated air will be furnished thereto when the door 128 closed.

The door duct 134 is mounted under the door basket 136 in this embodiment. But the door duct 134 can be mounted in the interior of the door basket 136. When the door duct is mounted in the door basket 136, the storage space of door basket 136 will be increased. And substantially the door duct 134 can be formed integrally with the door basket 136.

Circulation of refrigerated air according the above embodiment will be explained briefly. As refrigerating cycle drives, the refrigerated air generated by the evaporator 108 will be provided to the fresh food duct 122 and then to the fresh food compartment 120 through a plurality of outlets 124*a,* 124*b,* 124*c* forward. Simultaneously, a portion of the refrigerated air will be delivered to the door duct 134 through the shelf duct 132. The refrigerated air guided to the door duct 134 will be spouted to the fresh food compartment 120 through its outlets 134*b* rearward. The refrigerated air supply apparatus of this invention is providing the refrigerated air to the fresh food compartment 120 forward and rearward simultaneously by fresh food duct 122 and door duct 134 respectively. This means that the fresh food compartment 120 is cooled more quickly and more homogeneously than before.

Figure 5:
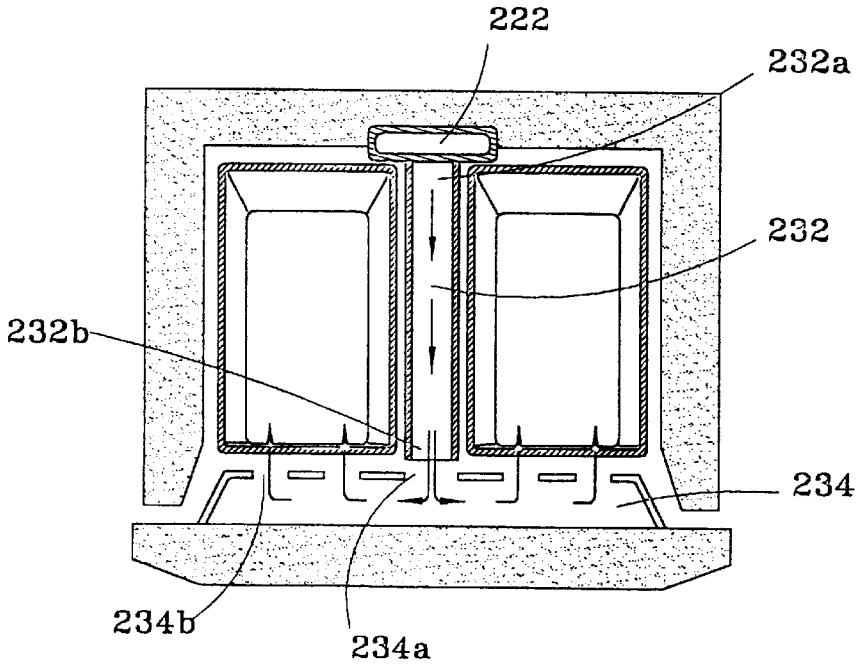
FIG. 5 is a section view taken substantially along the lines V—V in FIG. 4.
Figure 4:
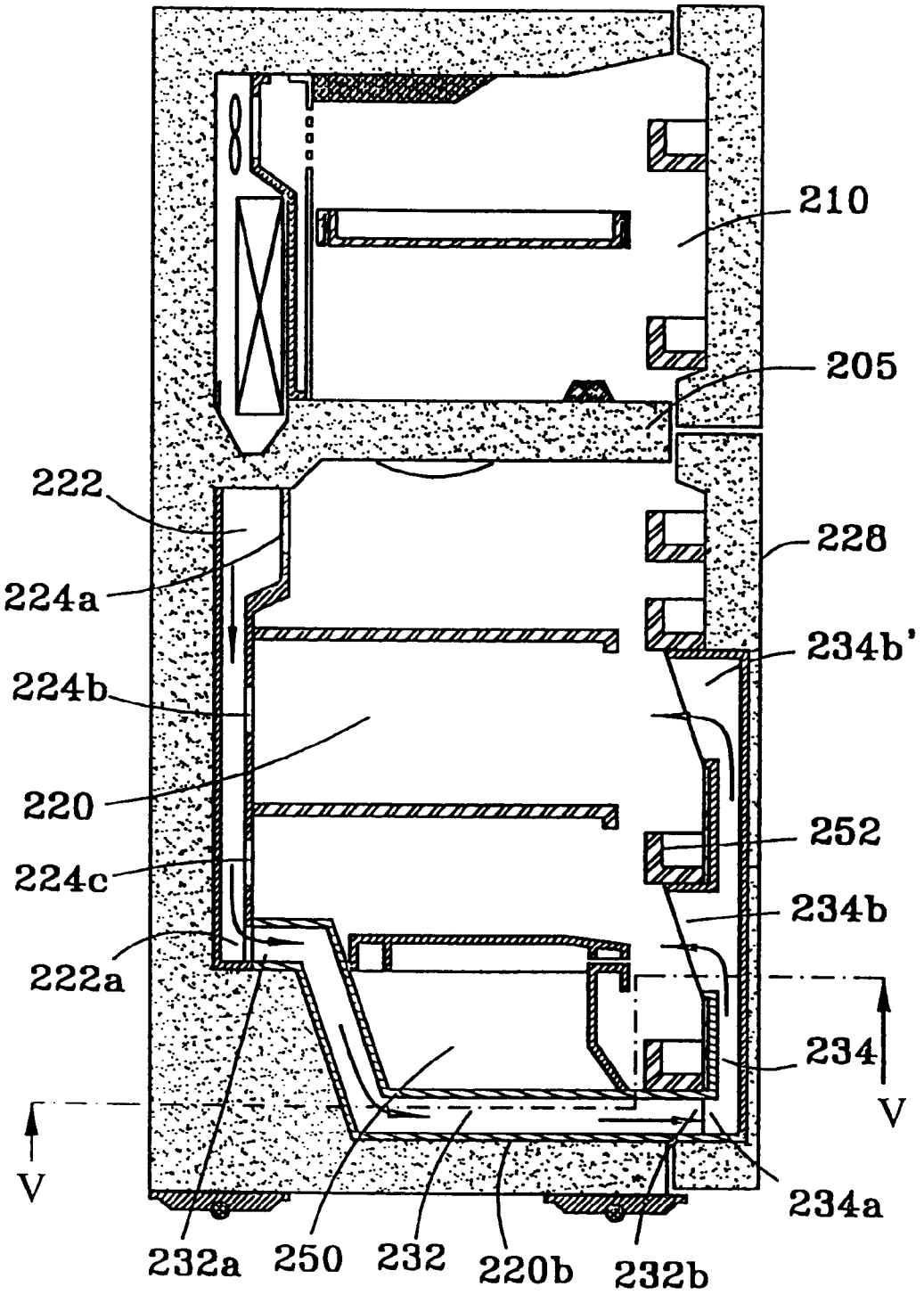
FIG. 4 is a longitudinal side section vies showing a refrigerated air supply apparatus in accordance with another embodiment of the invention.

Next, the second embodiment will be explained in view of FIGS. 4 and 5.

As is shown, refrigerated air supply to fresh food compartment 220 is achieved by a fresh food duct 222 mounted at the rear wall of fresh food compartment 220 and a door duct 232 mounted in the door 228 respectively. The fresh food duct 222 has a number of outlets 224*a,* 224*b,* 224*c* to spout the refrigerated air to the fresh food compartment 220 and an outlet 222*a* to provide refrigerated air to a connecting duct 232. The connecting duct 232 is mounted at the bottom wall of a storage box 250 which is slidably mounted at the bottom of fresh food compartment 220 to deliver refrigerated air to a door duct 234 mounted in the door 228.

The connecting duct 232 has an inlet 232*a* which is communicated with the outlet 222*a* of fresh food duct 222 and an outlet 232*b* which is communicated with a inlet 234*a* of the door duct 234 when door 228 closed. The connecting duct 232 of the invention is mounted at the bottom wall of fresh food compartment 220 across the storage box 250 that is a container where food such as vegetables and fruits are stored. In this embodiment, the connecting duct 232 is straightly extended forward through a bottom wall of the storage box 250. But it is understood that contour and structure of the connecting duct 232 is easily modified under the technical scope of the invention that connecting duct 232 delivers refrigerated air from the fresh food duct 222 to the door duct 234. For example, the connecting duct 232 can be mounted along with one side wall or upper wall of the storage box 250. In that case, positions of the outlet 232*b* of the connecting duct 232 and inlet 234*a* of the door duct 234 may be adjusted to communicate with each other.

The connecting duct 232 may have outlets(not shown) which provides communication with the interior of the storage box 250, considering that connecting duct 232 is mounted along with the bottom wall of the storage box 250. The food stored in the storage box 250 will be kept fresh by refrigerated air provided by the outlets.

And the connecting duct 232 may be formed separately and then assembled to the storage box 250. Otherwise the connecting duct 232 could be formed integrally with the storage box 250. The connecting duct 232 also may be formed integrally with fresh food duct 222.

According to the embodiment, the connecting duct 232 is mounted under the storage box 250 and a space occupied by the connecting duct 232 is not usually used for a storage space. It is understood that the fresh food compartment 220 can be fully utilized for food storage by the connecting duct 232 of the invention mounted in a portion which is not utilized as a storage space. In this point, the connecting duct 234 of the invention may be formed integrally with the bottom surface of the fresh food compartment 220.

Door duct 234 is mounted in the interior of the door 228 and provides refrigerated air into the fresh food compartment 220 through a plurality of outlets 234*b*, 234*b'* formed in the front surface thereof. Door duct 234 receives refrigerated air via a inlet 234*a* which is communicated with the outlet 232*b* of the connecting duct 232 and formed in the lower end of the door 228 and then spout the refrigerated air rearward via the outlets 234*b*, 234*b'*.

Also in this embodiment, refrigerated air is provided forward and rearward simultaneously in the fresh food compartment 220 by fresh food duct 222 and door duct 234 respectively. Such supplying of refrigerated air can furnish prompt and uniform cooling in the fresh food compartment 220.

The door duct 234 has an inlet 234*a* formed at the lower end of door 228 and a pair of outlets 234*b*, 234*b'*. The outlets 234*b'* is formed at the upper end of the door duct 234 and the outlets 234*b* is formed in the middle portion of the door duct 234. The outlets 234*b*, 234*b'* is formed near the door basket 252 and preferably they are formed in a position that refrigerated air spouted therefrom passes across the food stored in the door basket 252, thereby keeping the food fresh. Of course, the door duct 232 of the embodiment could be applied to the first embodiment.

Also in this embodiment, the door duct 234 could be formed in the interior of the door basket 252 or integrally with the door basket 252.

The fresh food duct 222 means a passage duct which provides refrigerated air to the fresh food compartment 220, like the conventional one. And it is understood that there are various kinds of known fresh food duct and the connecting duct of this invention which is mounted along with the storage box 250 can be applied to any of conventional fresh food duct. For example, the fresh food duct 222 may be mounted at the corner of inner wall or on one side wall of the fresh food compartment 220, and the connecting duct 232 of the invention may be mounted along with the storage box 250 with its inlet communicating with the fresh food duct.

As stated above, the connecting duct of the inventions is mounted along with shelves mounted horizontally in the interior of the fresh food compartment or along with storage box mounted at the bottom of the fresh food compartment. The shelves 130*a*, 130*b* or storage box 250 are components which are served for storage of food. This invention minimize the space occupied by the connecting duct by mounting it along with components for storing food, such as shelves or storage box, thereby maximizing the storage space in the fresh food compartment. And this invention could be worked easily by forming the connecting duct integral with the shelves or storage box.

The supply apparatus of the invention provides homogeneous cooling of fresh food compartment by spouting the refrigerated air simultaneously from fresh food duct and door duct respectively. And the fresh food compartment is promptly cooled since refrigerated air is provided rearward and forward simultaneously in the fresh food compartment.

Substantially the door adjacent portion is tent to be easily warmed, due to the inflow of warm air with door opened. The apparatus of this invention provides refrigerated air concentratedly in the door adjacent portion by door duct when door closed, thereby cooling the portion promptly. Accordingly, food stored in a door adjacent portion in the fresh food compartment will be kept fresh relatively in long time in spite of frequent opening of the door.

Further, the food stored in the door basket which contacts relative warm air when door opened can be kept fresher by forming the outlets of the door duct in a position that refrigerated air spouted therefrom passes across the food stored in the door basket.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerated air supply apparatus for a refrigerator having at least a compartment defined by inner walls and a door closing the compartment, comprising:

a providing duct mounted on an inner wall of the compartment for providing refrigerated air to the compartment;

a component mounted in the compartment for storing food;

a connecting duct interconnected to said component and communicating with the providing duct to guide refrigerated air received from the providing duct; and a door duct mounted in the door and communicating with the connecting duct, the door duct delivering rearward the refrigerated air that has been guided by the connecting duct.

2. A refrigerated air supply apparatus as claimed in claim 1, wherein said component is a shelf mounted horizontally in the compartment.

3. A refrigerated air supply apparatus as claimed in claim 2, wherein said connecting duct is formed integrally with said shelf.

4. A refrigerated air supply apparatus as claimed in claim 1, wherein said component is a storage box mounted at the bottom of the compartment.

5. A refrigerated air supply apparatus as claimed in claim 4, wherein the connecting duct is formed integrally with said storage box.

6. A refrigerated air supply apparatus as claimed in claim 4, wherein the connecting duct is mounted under the storage box.

7. A refrigerated air supply apparatus as claimed in claim 5, wherein the connecting duct is formed integrally with said providing duct.

8. A refrigerated air supply apparatus as claimed in claim 1, wherein the connecting duct is formed integrally with the providing duct.

9. A refrigerated air supply apparatus as claimed in claim 1, wherein the refrigerated air provided into the compartment rearward from said door duct, passes across food stored in the door basket.

10. A refrigerated air supply apparatus as claimed in claim 9, wherein the door duct is mounted in the door.

11. A refrigerated air supply apparatus as claimed in claim 9, wherein the door duct is formed integrally with the door basket.

12. A refrigerated air supply apparatus as claimed in claim 2, wherein the refrigerated air provided into the compartment rearward from said door duct, passes across food stored in the door basket.

13. A refrigerated air supply apparatus as claimed in claim 3, wherein the refrigerated air provided into the compartment rearward from said door duct, passes across food stored in the door basket.

14. A refrigerated air supply apparatus as claimed in claim 4, wherein the refrigerated air provided into the compartment rearward from said door duct, passes across food stored in the door basket.

15. A refrigerated air supply apparatus as claimed in claim 5, wherein the refrigerated air provided into the compartment rearward from said door duct, passes across food stored in the door basket.

16. A refrigerated air supply apparatus as claimed in claim 6, wherein the refrigerated air provided into the compartment rearward from said door duct, passes across food stored in the door basket.

17. A refrigerated air supply apparatus as claimed in claim 7, wherein the refrigerated air provided into the compartment rearward from said door duct, passes across food stored in the door basket.

18. A refrigerated air supply apparatus as claimed in claim 8, wherein the refrigerated air provided into the compartment rearward from said door duct, passes across food stored in the door basket.

19. A refrigerated air supply means and apparatus for a refrigerator having at least a compartment defined by inner walls and a door closing the compartment, comprising:

providing duct means, mounted on an inner wall of the compartment, for providing refrigerated air to the compartment;

component means, mounted in the compartment, for storing food;

connecting duct means, interconnected to said component and communicating with the providing duct means, to guide refrigerated air received from the providing duct means; and door duct means, mounted in the door and communicating with the connecting duct means, for delivering rearward the refrigerated air that has been guided by the connecting duct means.

20. A refrigerated air supply means and apparatus as claimed in claim 19, wherein said component means is a shelf mounted horizontally in the compartment.

* * * * *